US005209395A

United States Patent [19]

Zouzoulas et al.

[11] Patent Number: 5,209,395

[45] Date of Patent: May 11, 1993

[54] METHOD AND APPARATUS FOR A LOCKABLE, REMOVABLE CASSETTE, FOR SECURELY STORING CURRENCY

[75] Inventors: John Zouzoulas, West Chester; Raymond D. Regan, Downingtown; Robert Clauser, Coatesville, all of Pa.

[73] Assignee: Mars Incorporated, McLean, Va.

[21] Appl. No.: 704,787

[22] Filed: May 23, 1991

[51] Int. Cl.[5] ..... G07B 15/00; E05G 1/04

[52] U.S. Cl. ..... 232/15; 232/1 D; 271/181; 109/59 R; 109/66; 109/45

[58] Field of Search ..... 232/15, 16, 1 D, 31, 232/32, 7; 271/180, 181; 109/45, 50, 152, 59, 66

[56] References Cited

U.S. PATENT DOCUMENTS

| | | | |
|---|---|---|---|
| 901,778 | 10/1908 | Bucknom | 232/15 |
| 1,394,941 | 10/1921 | Ruebsamen | 232/15 |
| 2,973,139 | 2/1961 | Leone | 232/15 |
| 3,016,185 | 1/1962 | Osborne | 232/15 |
| 3,773,252 | 11/1973 | Jensen | 232/15 |
| 3,966,116 | 6/1976 | Dominick | 232/16 |
| 4,313,601 | 2/1982 | Graef et al. . | |
| 4,341,100 | 7/1982 | Kohlhage | 232/15 |
| 4,434,931 | 3/1984 | Hunt | 232/15 |
| 4,648,327 | 3/1987 | Toth et al. . | |
| 4,807,736 | 2/1989 | Kondo et al. . | |
| 4,834,230 | 5/1989 | Kondo et al. . | |
| 4,840,368 | 6/1989 | Uehara . | |
| 4,854,247 | 8/1989 | Sciortino | 109/52 |
| 4,877,179 | 10/1989 | Baker et al. . | |
| 4,896,826 | 1/1990 | Bernier . | |
| 4,949,901 | 8/1990 | Harris . | |
| 4,977,583 | 12/1990 | Gorgone . | |
| 4,997,128 | 3/1991 | Suris . | |
| 5,014,857 | 5/1991 | Kondo . | |

*Primary Examiner*—Peter M. Cuomo
*Assistant Examiner*—Flemming Saether
*Attorney, Agent, or Firm*—Davis Hoxie Faithfull & Hapgood

[57] ABSTRACT

A method and apparatus for a lockable, removable cassette for attachment to a bill validator is disclosed. The cassette is removed from a bill validator by service personnel and transported to a central office, where an authorized person unlocks a hinged door with a separate key to remove stored bills. A lever is turned to a predetermined position which unlocks the cassette from the bill validator, and locks a pusher plate to prevent unauthorized bill removal. The lever is prevented from being turned clockwise and from further rotation past the predetermined position. When the hinged door of the secured cassette is opened by authorized personnel, the lever is released from its locked position arming the cassette. The emptied cassette can now be returned to the service person who can now reconnect it to a bill validator by further rotating the lever, which locks the cassette in place and unlocks the pusher plate to prepare the cassette to receive bills accepted by the validator. The cassette is easy to use, compact, tamper resistant, durable, and may use only mechanical parts. Further, the cassette can be modified to store a larger or smaller amount of bills, and works with existing bill pushers with only minor modifications required.

41 Claims, 10 Drawing Sheets

0 DEGREES ROTATION

100 DEGREES ROTATION

180 DEGREES ROTATION

METHOD AND APPARATUS FOR A LOCKABLE, REMOVABLE CASSETTE, FOR SECURELY STORING CURRENCY

FIELD OF THE INVENTION

The present invention relates generally to an improved lockable, removable cassette method and apparatus. More particularly, the present invention relates to a lockable, removable cassette for connection to a bill acceptor wherein bills are securely stored in a bill compartment within the cassette. After accessing a cabinet, which may be locked, where the lockable cassette and bill acceptor are located, a serviceman can easily and quickly remove the full cassette and replace it with an empty one. The serviceman typically does not have access to the bill compartment. A separate key, usually available at a central office, is required to unlock the cassette so that the stored bills can be removed. Further, the bill acceptor is inoperable if the lockable, removable cassette is not properly affixed to the bill validator.

BACKGROUND OF THE INVENTION

It is well known that temptations arise when service personnel handle cash collected by a currency validator. It is also known that vandals target currency validators. Thus, it is expected that the cash box connected to such devices will be abused.

When a cash box which contains cash that is less than that amount for which services or change were rendered is delivered to a central office, it is uncertain whether or not the validator malfunctioned, or if the serviceman is dishonest. Therefore, it is desirable to provide a removable, lockable cash box for currency validators in which the stored bills cannot be accessed by service personnel.

Thus, lockable, removable cash boxes for use with currency validators have been developed. See, for example, U.S. Pat. Nos. 4,949,901, 4,977,583 and 4,997,128. In these patents, a cash box connected to a currency validator receives accepted bills and locks prior to its removal from the validator. Service personnel remove the cash box at predetermined intervals or when it is full, and replace it with another empty one. The full cash box is then taken to a central office where it is opened with a separate key.

The cash box described in U.S. Pat. No. 4,997,128 employs a continuous sleeve having a window. When connected to a bill acceptor, the sleeve is positioned to receive bills through the window. Before removal, the sleeve is rotated around rollers by a motor or by the release of a torsion spring, to close the window. The sleeve does not appear to be durable, and therefore forced entry into the cash box to steal bills might be attempted. Further, the spring loaded embodiment may be susceptible to being opened by shocks, such as dropping the cash box onto the pavement. A serviceman may then be tempted to steal some bills and relock the cash box, known as skimming bills, before delivery to the central office.

The cash box described in U.S. Pat. No. 4,949,901 employs a semi-cylindrical inner housing which rotates upon removal into a position to prevent access to the stored bills. The rotation may cause jamming of bills, thus preventing removal of the cash box from the validator. Further, machines which employ cash boxes often have limited space, and this design is not compact. Therefore, the size of the bill storage compartment is limited by the size of the housings required to permit rotation of a large amount of bills.

Other lockable prior art cash boxes have used electronic solenoids to move various pusher plates, electronic counters to keep track of the amount of bills stored, and other circuitry to attempt to deal with the potential theft and fraud problems. Yet other approaches have used fragile spring locking mechanisms. These designs were expensive to manufacture and maintain, and could be relatively easily defeated by cutting power to the system, by rough treatment of the cassette, or by some other tampering.

SUMMARY OF THE INVENTION

The apparatus of the present invention provides a durable, lockable, removable cassette for use with a bill validator. The cassette provides improved security, is easy to use, and is tamper resistant while allowing for secure and compact storage of large numbers of bills. These improvements are achieved without the use of any electronic parts, and without relying on spring locking mechanisms.

A lockable, removable cassette apparatus may be highly desirable when improved security is necessary, such as when somewhat higher priced products or services are to be vended. For example, the present lockable, removable cassette may be used to store bills accepted by a bill validator housed in a gasoline pump. Customers pay for the amount of gasoline pumped by inserting bills into the validator. A range of bill denominations including higher denomination bills, such as 5-dollar, 10-dollar and 20-dollar bills, may be tendered resulting in a large amount of money being stored in the lockable, removable cassette.

One embodiment of a lockable, removable cassette according to the present invention is rectangular in shape, has a casing composed of metal or another durable material, and can be attached to existing bill pushers with only minor modifications. A knob or lever located on the outside front wall of the cassette is turned by service personnel to mount and dismount the cassette to a validator apparatus. Provision is made so that the knob or lever may be padlocked to the cassette housing, thus requiring a key to remove the padlock before turning the lever to dismount the cassette.

In a presently preferred embodiment, the lever is turned counterclockwise 180 degrees by a serviceman to remove the cassette. As the lever is turned, a pusher plate locks in position to prevent access to the stored bills. A camming arrangement prevents the lever from being turned past 180 degrees. The locked cassette is transported back to a central office where a separate key is used to open a hinged door to access the stored bills. Opening the hinged door and removing all of the stored bills releases the lever, permitting rotation past the 180 degrees position so that the lever can be returned to its starting position The cassette is now considered armed and a serviceman can remount it. To reconnect the emptied and armed cassette to a validator, the serviceman turns the lever from the 180 degree position to 360 degrees or 0 degrees, the starting position. Thus, the serviceman is unaware of the way in which the inner locking arrangement operates, and merely removes full cassettes and replaces them with empty cassettes.

The lever is connected to a locking shaft located inside the cassette. The locking shaft contains various cams which turn to lock and unlock the cassette to the validator apparatus, and also function to lock and unlock a pusher plate.

The pusher plate fits into the rear wall of the cassette. When the cassette is attached to the validator apparatus, the pusher plate may move in and out of a bill compartment. Accepted bills are transported behind the pusher plate, and an actuator plate of a bill pusher contacts the pusher plate to force bills through an opening into the bill compartment. Upon removal of the cassette from the validator apparatus, the pusher plate locks in place to block the bill opening. As will be discussed further below, the rear wall of the cassette contains design features which increase the difficulty of removing bills through the small gaps around the pusher plate when the cassette is removed from the validator.

The present invention also contains two cassette detection pins which connect and align the cassette to the validator apparatus. At least one detection pin displaces a cassette detection shaft in the validator apparatus to send a signal that the cassette is in place. If the validator does not receive this signal it will not function. The cassette detection shaft may also connect to an external signalling apparatus, such as a monitor or counter, to keep track of cassette placement, and to monitor events such as the number of times the cassette is removed or replaced.

A separate counter in the bill validator keeps track of the amount of money accepted by the bill validator. Therefore, if a serviceman somehow opens the cassette and removes some of the bills, and then reattaches the cassette so that it will refill, the discrepancy in the amount of money removed at the central office and that recorded by the counter in the validator will be apparent to the cassette owner.

The lockable shaft and camming arrangement of the present invention uses a minimal number of springs. Thus, harsh treatment of the cassette, such as dropping it from a height of four feet or more onto pavement, will not defeat the locking mechanism. The cassette cannot be forced open without damaging the outer casing thereby providing visual evidence of tampering or attempted efforts to tamper with the cassette.

In addition, the lockable, removable cassette of the present invention uses only mechanical parts, thus no motors or power supplies are required. This results in lower manufacturing costs and lower maintenance costs, and eliminates any possibility that the cassette can be defrauded by electrical or electronic tampering.

Further, the cassette may be readily manufactured to accept a larger or smaller amount of bills with only minor modifications. Also, currently available bill pushers need only minor modifications to work with the presently preferred embodiment of the invention.

Thus, a lockable, removable cassette in accordance with the present invention is durable, easy to use, tamper resistant, and may be manufactured to hold more or less bills dependent on customer requirements. These and other advantages will be apparent from the following detailed description. It will also be apparent that an embodiment of the invention need not achieve all of the advantages outlined herein to come within the scope of the present invention as defined by the claims.

Throughout this specification and claims, where reference is made to a "bill" or "bills", the reference is intended to include all types of paper currency and the like.

DETAILED DESCRIPTION

Figure 1:
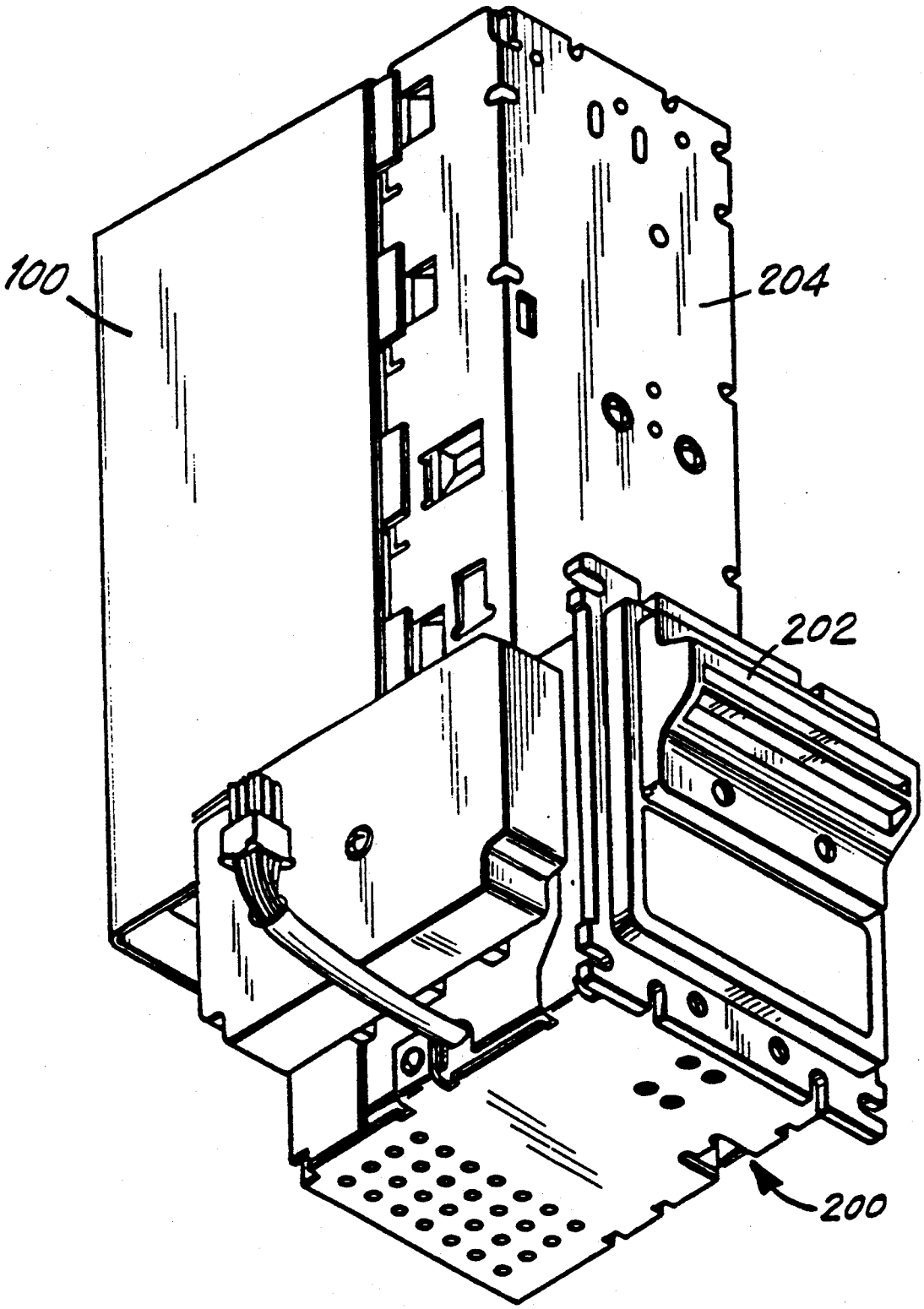
FIG. 1 illustrates a lockable, removable cassette according to the present invention connected to a bill validator and a bill pusher apparatus.

FIG. 1 shows a lockable, removable cassette 100 for the secure storage of bills, connected to a bill validator apparatus 200. The presently preferred embodiment of the cassette 100 is rectangular in shape, with an outside casing composed predominantly of metal. The cassette and the validator are typically enclosed within a locked cabinet so that only the face 202 of the validator is accessible to the public. A bill inserted into the bill validator 200 is tested to determine if it is genuine. If the bill is rejected, it is pushed back out at the face 202. If the bill is accepted, it is transported along a bill path (not shown) to a bill pusher 204. The bill is then pushed into a bill compartment 30 (shown in FIG. 3) of the cassette 100 where it is stored. The details regarding the operation of bill validators in conjunction with bill pushers are not part of the present invention and will not be described further. However, the present invention attaches to a bill pusher, and therefore some details regarding bill pusher operation will be further described below. An example of a suitable bill pusher for use with the present invention is described in U.S. Pat. No. 4,765,607, assigned to the assignee of the present application.

Figure 2:
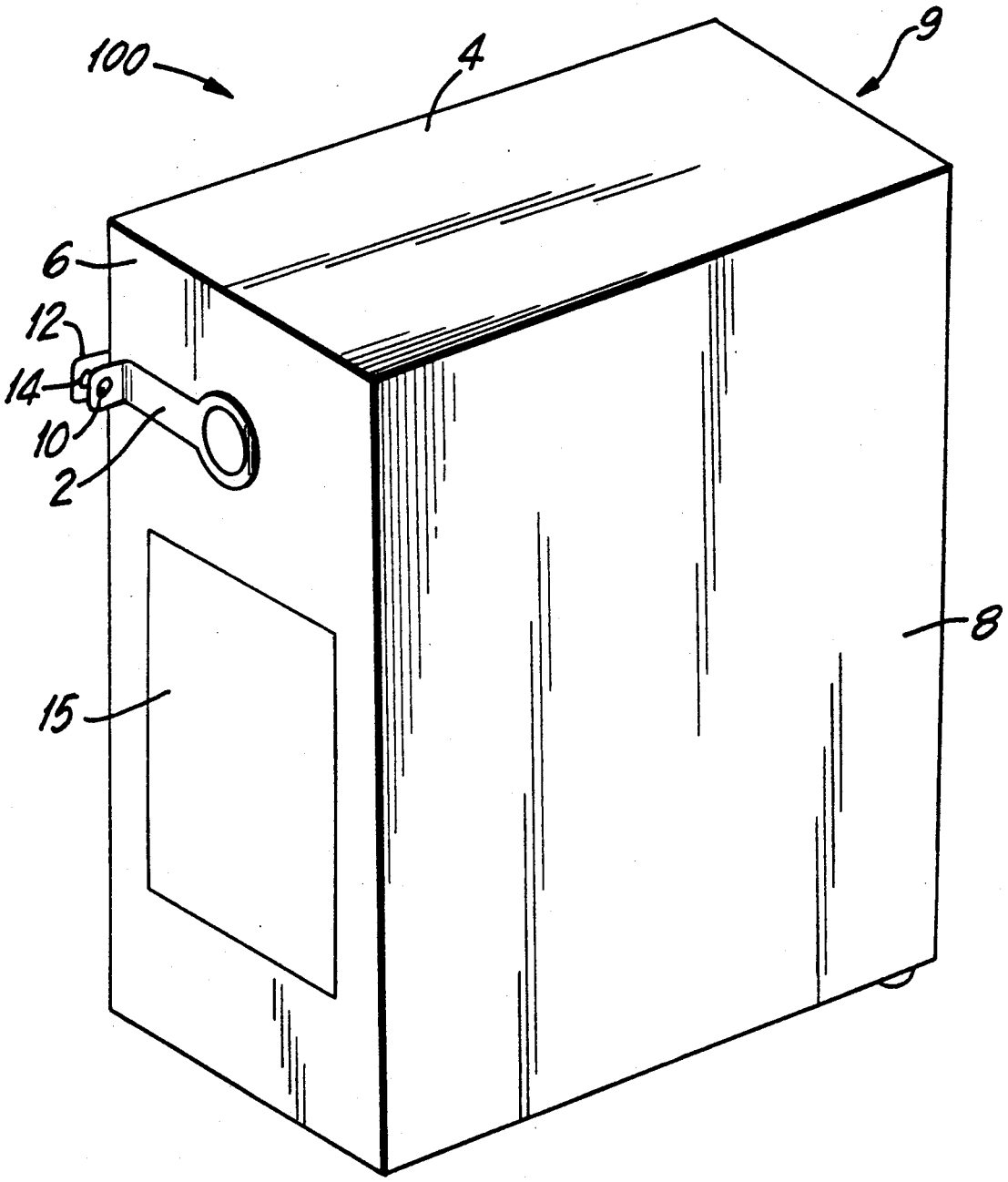
FIG. 2 is a simplified illustration of the cassette of the present invention.

FIG. 2 is a simplified drawing of a lockable, removable cassette 100 according to the present invention. The cassette 100 has a top wall 4, front wall 6 and side walls 8 which are rigidly connected to one another. Bills are pushed into the cassette through an opening in a rear wall 9, and are removed by unlocking a hinged door 40 (shown in FIG. 3) on the bottom of the cassette, details of which will be explained below. A knob or lever 2 protrudes from the front wall 6 and may have a handle having a hole 10. A flange 12 is mounted on one of the side walls 8, and has a hole 14. A padlock (not shown) may be attached through the holes 10 and 14 to prevent rotation of the lever 2. Thus, a serviceman may be required to carry a key to remove the padlock before turning the lever 2. A label 15 containing directions for removal of the cassette may be attached to the front wall 6.

Service personnel typically remove cassettes at predetermined intervals or when the cassettes are full of bills. A cabinet (not shown) ordinarily must be unlocked by the serviceman to access the cassette 100. Referring to FIG. 2, the knob or lever 2 must be turned to unlock the cassette from the validator. The cassette is then lifted out of slots 206 (shown in FIG. 6), and transported back to a central office. A separate key is used by an authorized person to unlock a lock 42 (shown in FIG. 3) to permit a hinged door 40 to be opened, to remove stored bills. After the bills are removed, the cassette 100 is given back to the serviceman for connection to another bill validator. When reconnecting the cassette to a bill validator, the serviceman again turns the knob or lever 2 to lock the cassette into place. Thus, servicemen are unaware of the inner workings of the cassette. They merely remove full cassettes, replace them with empty cassettes, and return the full cassettes to the central office.

Figure 3:
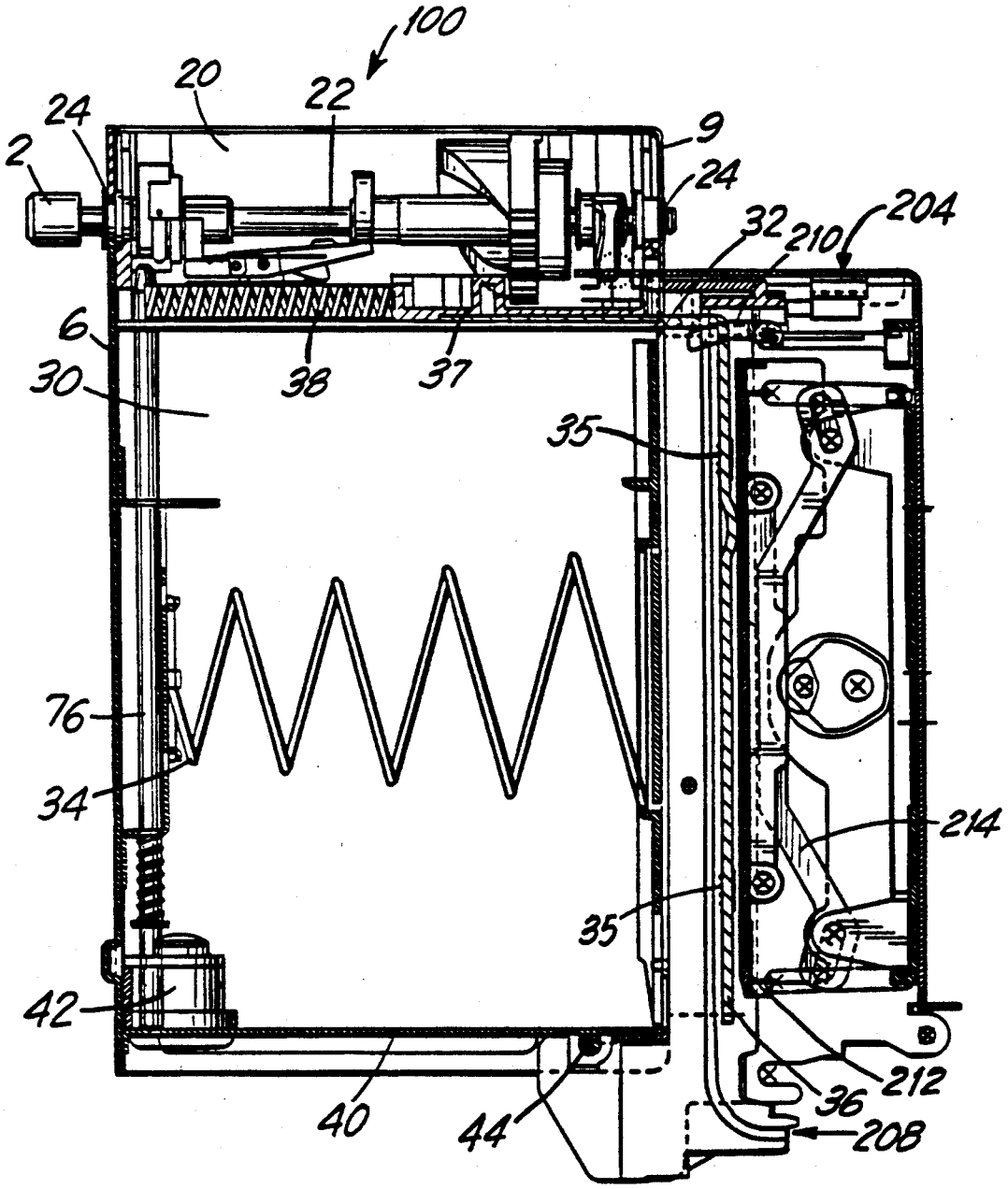
FIG. 3 is a cutaway side view of an embodiment of the cassette according to the present invention shown connected to a bill pusher and shown ready to receive bills from a bill validator.

FIG. 3 is a detailed cutaway side view of an empty lockable, removable cassette 100 connected to a bill pusher 204. In FIG. 3, the cassette 100 is shown empty and ready to receive bills. The cassette 100 is comprised of two compartments: a shaft compartment 20 and a bill storage compartment 30. The shaft compartment 20 houses the mechanism which locks the cassette 100 to the bill pusher 204, and which secures the bill storage compartment upon removal of the cassette. A locking shaft 22 is mounted to the front wall 6 and rear wall 9 by bushings 24, which permit the locking shaft 22 to rotate when the lever 2 is turned. The locking shaft 22 is a D-shaped shaft. Various cams having D-shaped holes are mounted on the locking shaft 22 such that the cams rotate when the knob or lever 2 is turned. Details concerning how these cams work will be discussed further below in conjunction with FIGS. 8A to 10B.

The bill storage compartment 30 contains a pressure plate 32 attached to a conical spring 34. The conical spring 34 biases the pressure plate 32 toward the rear wall 9 of the cassette 100. A pusher plate 36 is rigidly connected to a sliding pad 37, which rides on tracks (not shown) in the shaft compartment 20. Two pad springs 38 act to bias the sliding pad 37 towards the rear wall 9. Thus, the pusher plate 36 is biased into its open position as shown in FIG. 3.

During operation, an accepted bill is transported by the validator apparatus along a bill path 208 behind the pusher plate 36. When the bill reaches the top of bill path 208, it touches bill detector blades 210, located on either side of the bill passageway 208, which send a signal to the bill pusher 204 to push the bill towards the bill compartment 30. An actuator plate 212, connected to a scissors arrangement 214, pushes pusher plate 36 against the bill. The pusher plate 36 has teeth 35 which contact the bill to keep it from slipping. The bill is pushed through an opening 51 (shown in FIG. 5) in the rear wall 9 to move into the bill compartment 30. The bill contacts the pressure plate 32 which holds it in place inside the bill compartment 30, as will be described below in conjunction with FIG. 5.

Figure 7:
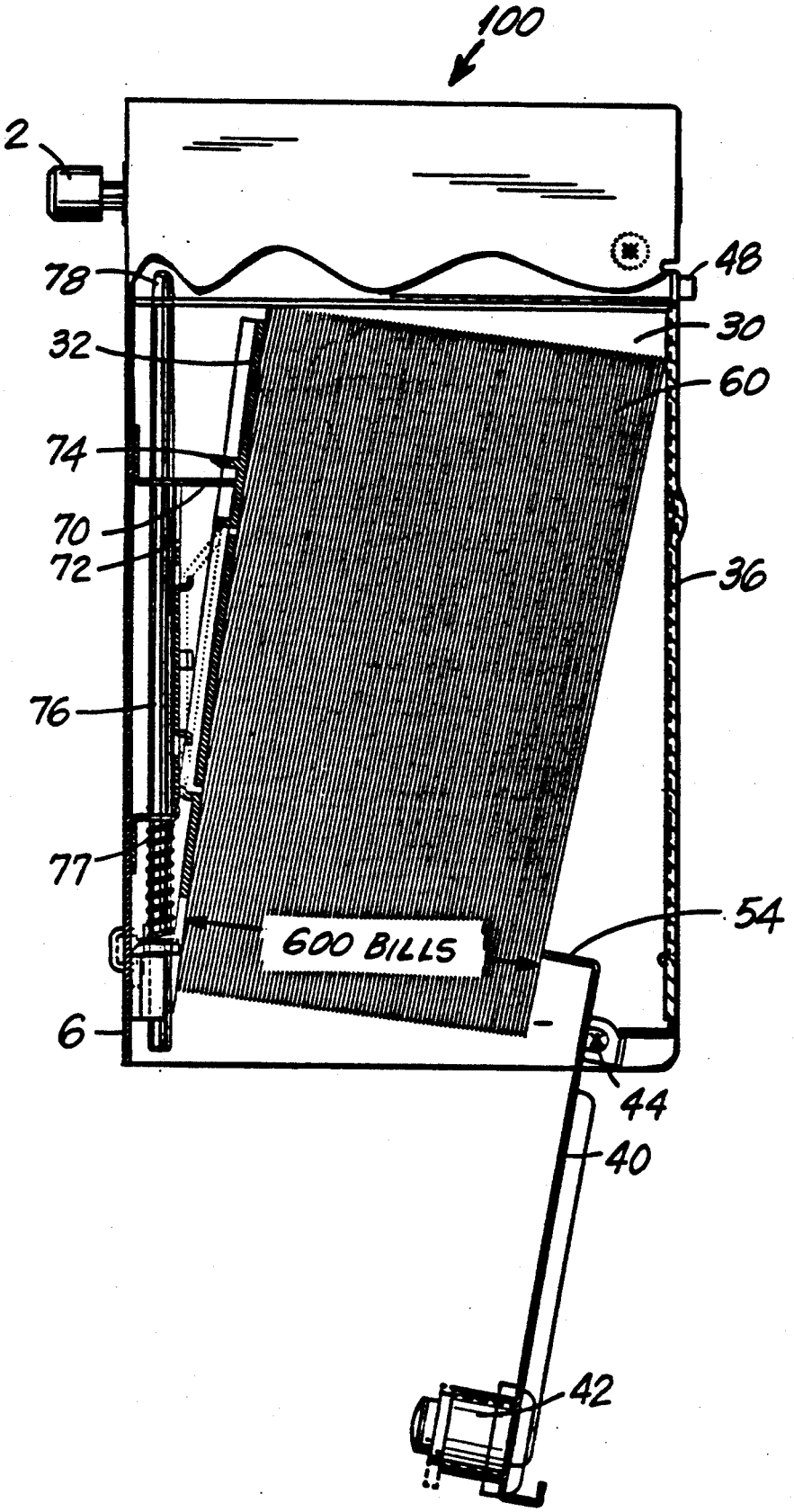
FIG. 7 is a partial cutaway side view of the cassette after removal from a bill validator, illustrating how bills are removed from the cassette.

Also shown in FIG. 3 is the hinged door 40 and associated lock 42. When unlocked, the hinged door 40 pivots about pin 44 to open (as shown in FIG. 7), and an arming shaft 76 moves in the downward direction. The significance of the arming shaft 76 will be discussed below in conjunction with FIGS. 11A to 11D.

Figure 4:
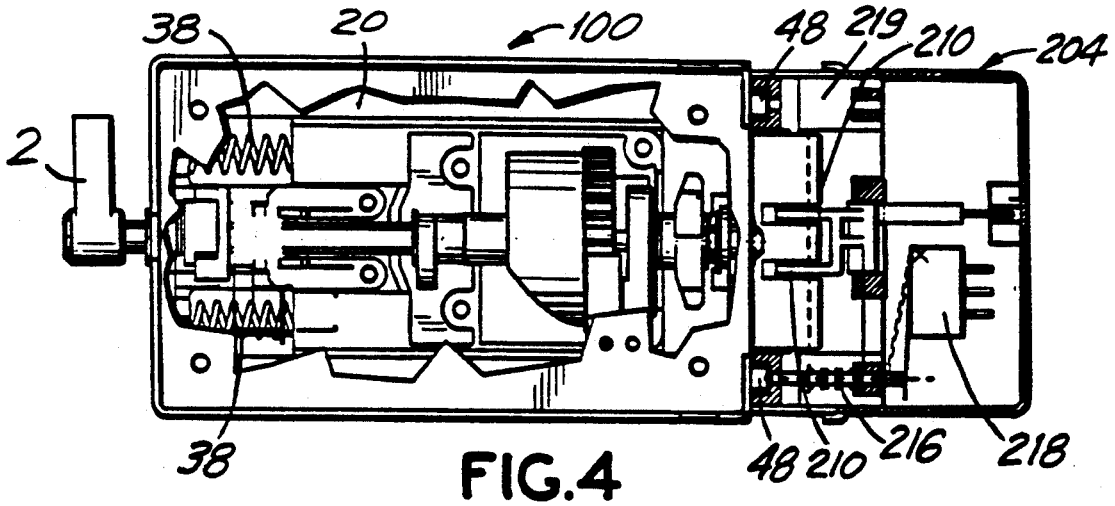
FIG. 4 is a cutaway top view of the cassette and bill pusher of FIG. 3.

FIG. 4 is a cutaway top view of the cassette 100 connected to the bill pusher 204. Attached to the rear wall 9 of the cassette 100 are two cassette detection pins 48 which fit snugly into slots located in the bill pusher 204, and perform a dual purpose. Each of the cassette detection pins 48 serves to align the cassette to the bill validator. At least one cassette detection pin 48 displaces an associated cassette detection shaft 216 which is in turn sensed by a microswitch 218. The microswitch 218 sends a signal to the validator apparatus 200 (shown in FIG. 1) to enable operation, and can also operate an external signal such as a monitor or a counter apparatus. Thus, events, such as the time and date of each removal of the cassette 100, can be easily detected and recorded. Room is left at location 219 to permit installation of a second cassette detection pin sensor if so desired.

Figure 5:
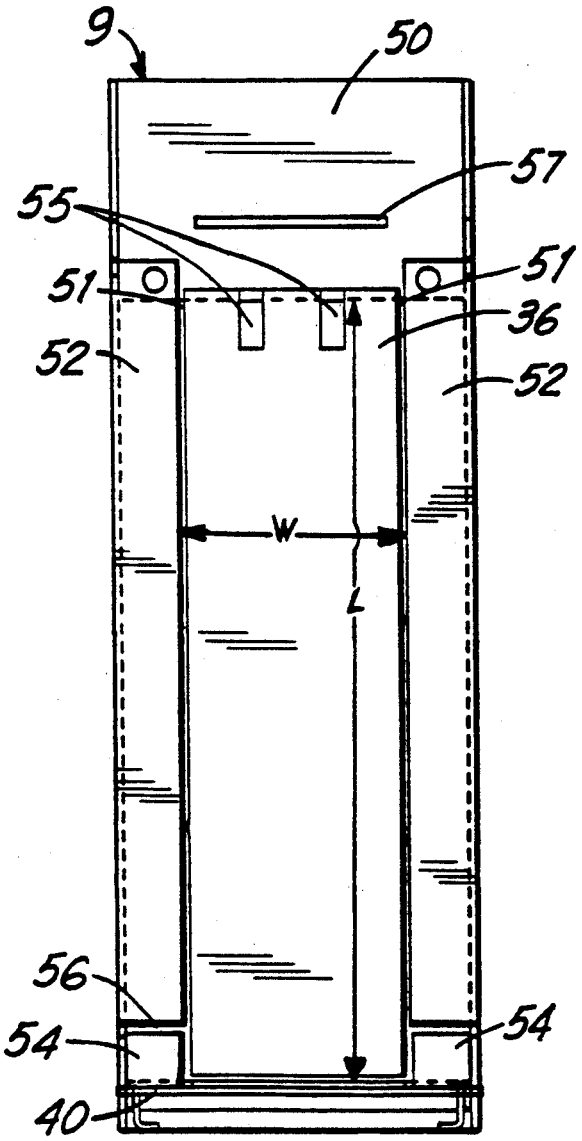
FIG. 5 illustrates details of the rear wall of the cassette.

FIG. 5 illustrates details of the rear wall 9 after the cassette 100 has been removed from the bill validator 200. A top plate 50, two lips 52, two ears 54 and the pusher plate 36 are all located in the same plane when the cassette 100 is detached from the bill pusher 204. Two blade slots 55 permit bill detector blades 210 (shown in FIGS. 3 and 4) to fit through them when the cassette is attached to the bill pusher 204, but are not large enough to permit bills to be extracted through them when the cassette is removed from the bill pusher. The lips 52 and ears 54 define the sides of a rectangular opening 51 having a width "W", which is less than the width of a bill. The opening 51 has a length "L" defined by the top of the bill compartment and the hinged door 40, which is longer than the length of a bill.

The ears 54 are mounted on the pivoted door 40 and extend from the pivoted door up to near the bottom of the lips 52 as shown. The ears 54 provide an uneven line of separation 56 between the bill storage compartment 30 (shown as a dotted line in FIG. 5) and the bottom of the pusher plate 36, thus making it more difficult to illicitly extract bills.

During operation, an accepted bill is transported along bill path 208 (shown in FIG. 3) behind the pusher plate 36 and in front of the lips 52 and ears 54, and then is pushed through the opening 51 by the pusher plate 36 when the actuator plate 212 is energized. The edges of the bill along its longest dimension fold as the pusher plate 36 drives it through the opening 51. The bill enters the bill compartment 30, then is pressed against the pressure plate 32 (shown in FIG. 3), and the edges unfold on the opposite side of the lips 52.

Figure 6:
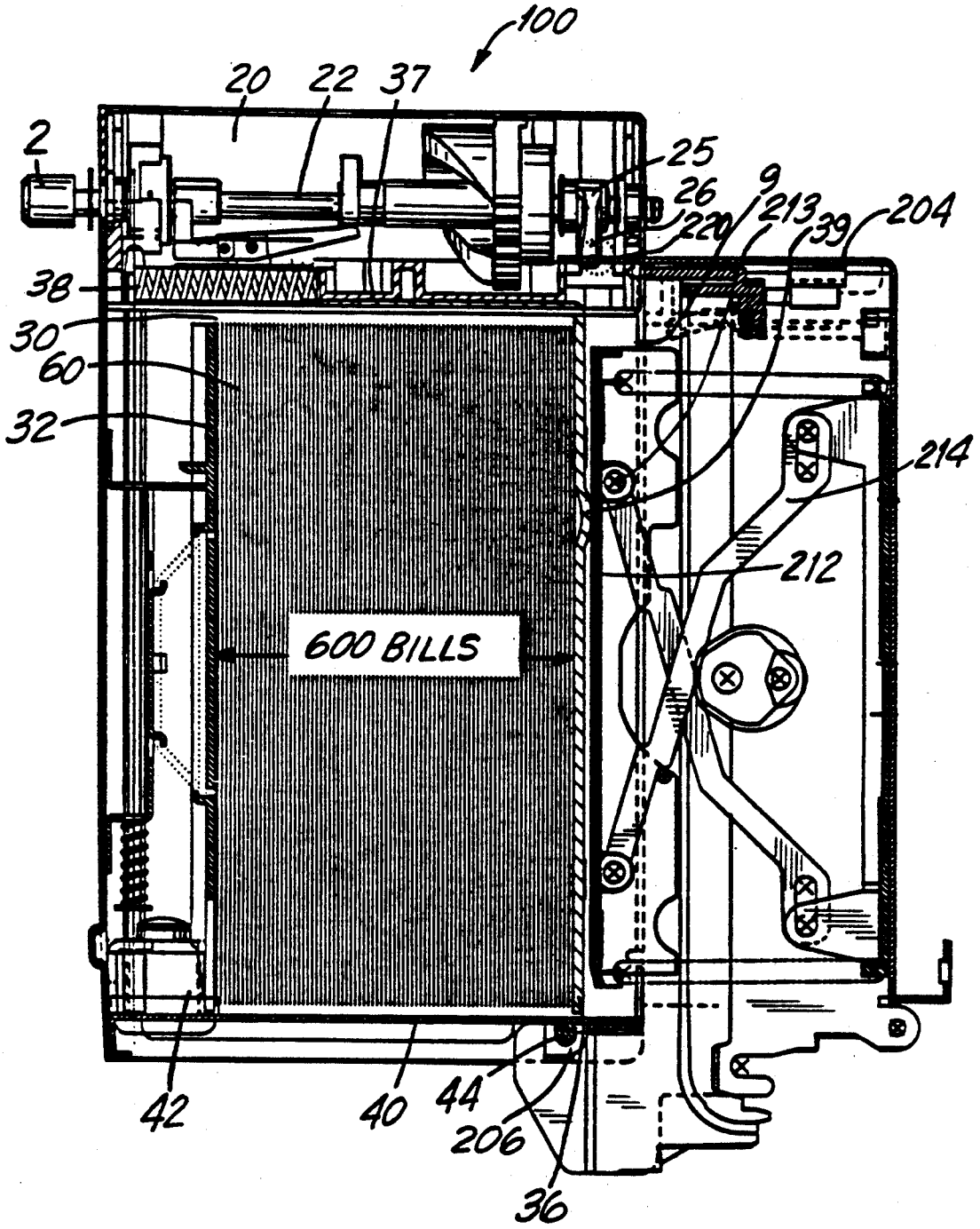
FIG. 6 is a cutaway side view of the cassette of FIG. 3 illustrating how bills are loaded and stored in the cassette.

FIG. 6 is another cutaway side view of the cassette 100 and bill pusher 204 of FIG. 3, illustrating the bill storage compartment 30 filled with bills 60. In the presently preferred embodiment, the bill storage compartment can store approximately 600 bills. However, the storage capacity can be easily altered to serve a particular customer's needs.

Referring to FIG. 6, the actuator plate 212 is shown fully extended, having driven a bill and the pusher plate 36 past the rear wall 9 of the cassette, through the opening 51 (shown in FIG. 5), and into the bill storage compartment 30. The actuator plate 212 contacts a bump 39 on the face of the pusher plate 36 when pushing a bill. The bump 39 is located as close as possible to the sliding pad 37 but below pivot pin 213 of the scissor arrangement 214, to reduce the bending moment that occurs at the top of the pusher plate 36.

After extending to store a bill, the actuator plate 212 is retracted by the scissors mechanism 214. The pusher plate 36 then retracts to its open position (shown in FIG. 3), succumbing to the bias supplied by the pad springs 38. The pressure plate 32 succumbs to the bias supplied by the conical spring 34, pushing the bills 60 back toward the inner surface of the rear wall 9 of the cassette 100. However, the opening 51 is too small for a bill to fit through without folding, and the most recent accepted bill will not fold because the bill and the pressure plate 32 are larger than the opening 51. Thus, the bills 60 are held between the pressure plate 32 and the lips 52 and ears 54 in the bill storage compartment 30.

As the bill storage compartment 30 is filled, the actuator plate 212 is subject to increasing resistance from the stacked bills 60. When the bill compartment 30 is full, a threshold resistance is reached, and the bill pusher 204 causes the validator apparatus 200 to go out of service.

Both FIGS. 3 and 6 depict the cassette 100 locked to the validator 200. To remove the cassette 100, in the presently preferred embodiment, the knob or lever 2 must be turned 180 degrees in the counterclockwise direction. It should be understood that the turning radius and direction is a matter of design choice, and that one skilled in the art could use other turning angles without departing from the scope of the present invention.

Referring to FIG. 6, when the lever 2 is turned counterclockwise 180 degrees, the locking shaft 22 turns a locking disc 25 so that a surface 26 disengages from a slot (not shown) on a tongue 220 of the bill pusher 204. Other cams on locking shaft 22 also rotate to ensure that the pusher plate 36 is locked in place to secure the cassette before removal. Details concerning this locking arrangement will be discussed below in conjunction with FIGS. 8A to 10B. The cassette 100 is then tilted approximately 10 degrees about anchor pins 44, and lifted out of the slots 206 of the bill pusher 204.

FIG. 7 shows a partial outaway view of the cassette 100 after removal from the validator apparatus 200. The lock 42 has been unlocked and the pivoted door 40 opened. When the hinged door 40 is opened, the ears 4 press into the stacked bills 60, pushing them toward the front of the bill storage compartment 30 to make removal of the bills easier for the owner. The pressure plate 32 contacts a rigid tap 70, mounted on an arming shaft housing 72, which pivots the pressure plate and the bills 60 as shown. The pressure plate 32 is prevented from sliding downwards by a tab 74, positioned to contact the rigid tab 70.

When the knob or lever 2 is turned 180 degrees counterclockwise to unlock the cassette 100 from the validator 200, an arming shaft 76 having a conical circumference 78 contacts a cam (not shown) to prevent further counterclockwise rotation of the knob or lever 2. Thus, the pusher plate 36 cannot be unlocked to gain access to the stored bills. When the hinged door is opened, the arming shaft 76 is biased downward by a spring 77 and disengages from the cam, to permit further counterclockwise rotation of the lever 2. Consequently, when the serviceman re-mounts the empty cassette 100, the lever 2 can now be turned counterclockwise another 180 degrees to rotate the surface 26 (shown in FIG. 6) to lock to cassette 100 to the bill validator apparatus 200, and to release the pusher plate 36 from its locked position. Details concerning the locking features of the cassette will be discussed further below with respect to FIGS. 8A to 11D.

Figure 8A:
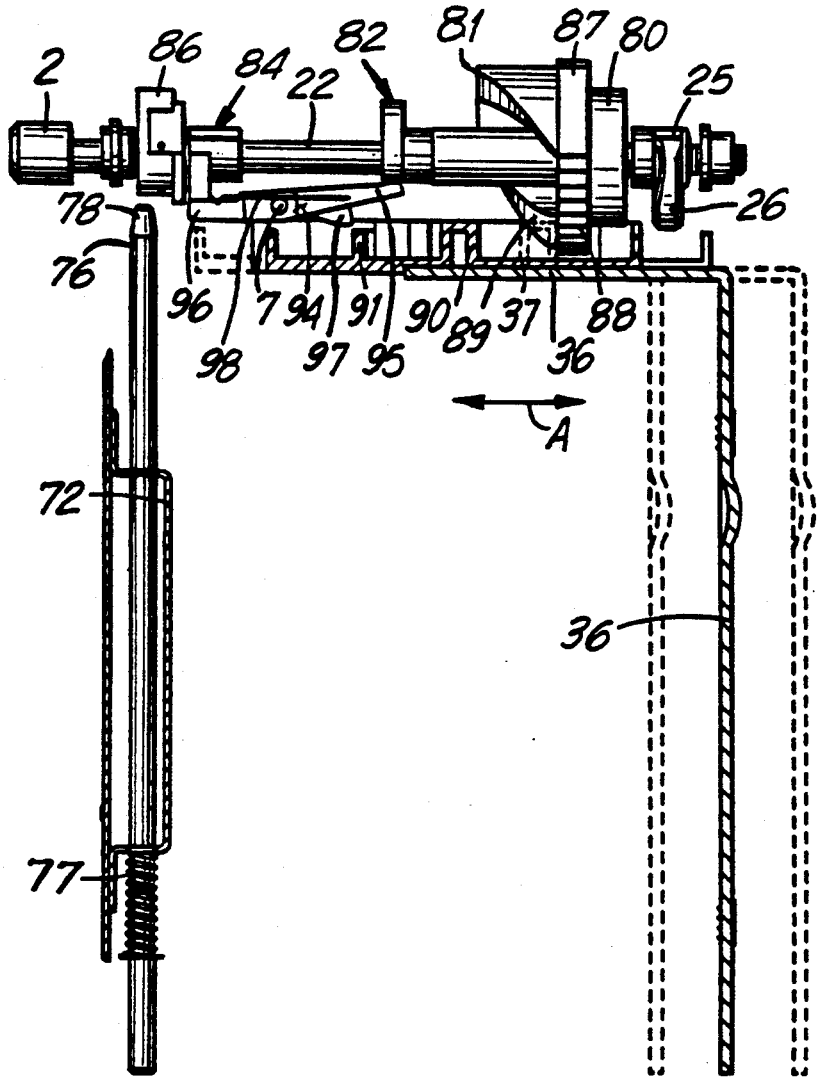
FIG. 8A is a side view illustrating various aspects of the locking mechanism of FIG. 3.

FIG. 8A is a detailed side view of the locking mechanism depicted in FIG. 3, shown in the absence of the walls of the cassette 100 to illustrate the locking mechanism at zero degrees rotation of the knob or lever 2, ready to receive bills. The pusher plate 36 and the sliding pad 37 can move from side to side in the direction of the arrows labeled "A". The dotted lines represent the position of the pusher plate 36 when it is in the open position, or furthest away from the lever 2, and when it has been pushed into the bill storage compartment 30 to store a bill.

Mounted on the locking shaft 22, from the rear to the front, are the locking disc 25, an axial cam 80, a latching radial cam 82, an unlatching radial cam 84, an extension spring cam 86 and the knob or lever 2. The surface 26 of the locking disc 25 is facing down, which is its position when the cassette is locked to the bill pusher, as described in connection with FIGS. 3 and 6.

The axial cam 80 has a base 87 which is cylindrical. A series of angled ratchet steps 88 project away from the center of the base 87. A spatula (not shown) is mounted within the shaft compartment 20 and extends into the base 87 at the ratchet steps 88. As the knob or lever 2 is rotated counterclockwise, the spatula tip slips over each ratchet step 88 to prevent clockwise rotation of the lever 2. As a result, the lever 2 cannot be turned clockwise back to 0 degrees after removal of the cassette 100 from the validator apparatus 200. Thus, after cassette removal, the pusher plate 36 cannot be returned to its opened position to illicitly extract bills.

The axial cam 80 also has an inclined surface 89 having a maximum height 81 which contacts a rib 90 of the sliding pad 37. The pad springs 38 (shown in FIG. 6) bias the sliding pad 37 to the rear of the cassette 100, so that when the lever 2 is at 0 degrees and the pusher plate 36 is in the open position (shown in FIG. 3) the rib 90 contacts the inclined surface 89 at the base 87 of the axial cam 80 (shown by the dotted line).

A latch 94 is shown in position over the sliding pad 37. The latch 94 is mounted on a pivot pin 7, and is located so that a stopper 95 is beneath the latching radial cam 82, and a tripper 96 is beneath the unlatching radial cam 84. A fin 97 is located in a notch in the latch 94, is mounted on the pivot pin 7, and is biased downwardly by a leaf spring 98. The fin 97 can be pushed into the notch in the latch 94 if acted upon by a force from below.

The arming shaft 76 is supported by the shaft housing 72, and its conical surface 78 is close to the spring cam 86. Further details regarding the function of the arming shaft 76 will be discussed below in conjunction with FIGS. 11A to 11D.

Figure 8B:
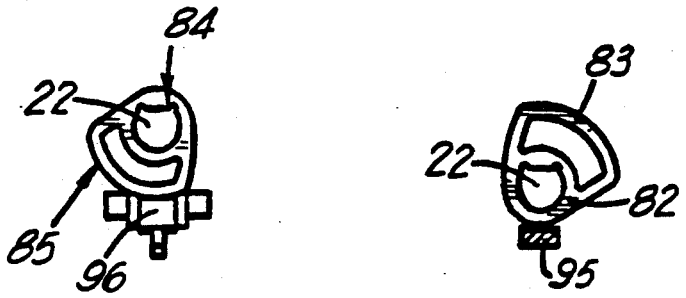
FIG. 8B is a front view of two cams shown in FIG. 8A, illustrating their positions.

FIG. 8B is a front, cutaway view of the unlatching cam 84 and latching cam 82 when the lever 2 is at 0 degrees. At this time a cylindrical cam surface 85 of the unlatching cam 84 is in contact with the tripper 96 of the latch 94. The stopper 95 is in contact with the base of the latching cam 82. The latch 94 is therefore in the unlatched position as shown in FIG. 8A. The fin 97 is raised such that a ledge 91 of the sliding pad 37 is free to slide under the fin, thus permitting the pusher plate 36 to move in and out of the bill compartment 30 as bills are loaded into the cassette.

Figure 9A:
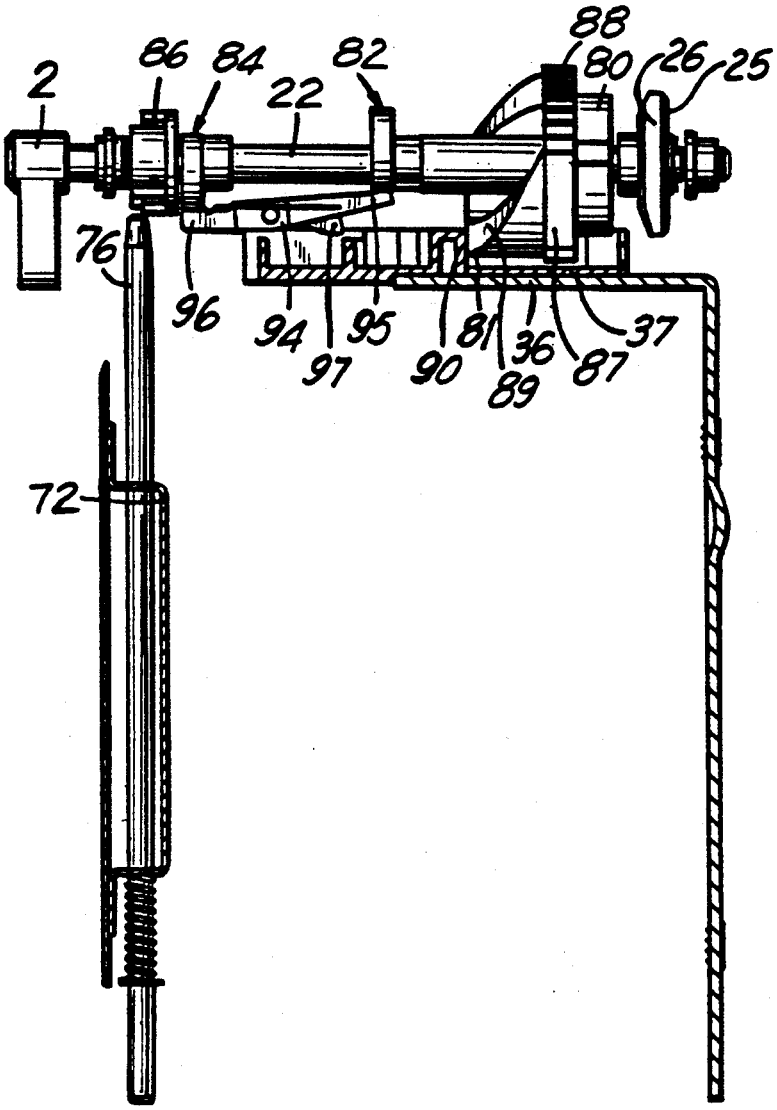
FIGS. 9A and 9B show the cams of FIGS. 8A and 8B rotated to 100 degrees.

FIG. 9A depicts the locking mechanism of FIG. 8A when the lever 2 has been rotated to 100 degrees. At 100 degrees rotation, the surface 26 of the locking disc 25 starts to disengage from a slot (not shown) on the tongue 220 of the bill validator 200 (shown in FIG. 6).

As the knob or lever 2 is turned from zero to 100 degrees, the inclined surface 89 is in constant sliding contact with the rib 90, to push the rib 90 and the sliding pad 37 towards the front of the cassette 100. When the contact point of the inclined surface 89 and the rib 90 is at its maximum height 81, the pusher plate 36 is covering the opening in rear wall 9. At this point the pusher plate 36 is in the closed position, as shown in FIG. 7. The contact point remains at this fixed height until approximately 220 degrees of rotation of the lever 2, which can occur only after the cassette is emptied and thereafter reattached to the bill pusher. As shown in FIG. 9A, when the lever 2 is turned to 100 degrees, the sliding pad 37 cannot move towards the rear wall of the cassette because the rib 90 is contacting the axial cam 80 at its maximum height 81.

Figure 9B:
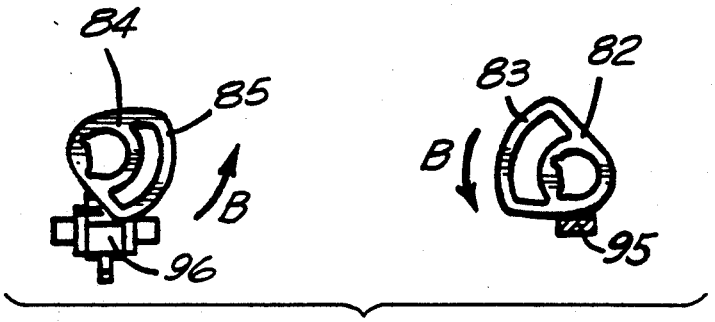

FIG. 9B is a front, cutaway view of the unlatching cam 84 and latching cam 82 of FIG. 8B when the knob or lever 2 has been turned in the direction of the arrows labeled "B" to 100 degrees. At this time, the cylindrical cam surface 85 of the unlatching cam 84 is beginning to lose contact with the tripper 96 of the latch 94, and the cylindrical cam surface 83 of the latching cam 82 is beginning to rotate into contact with the stopper 95. Referring to FIG. 9A, the tripper 96 will begin to move in the upward direction, and the stopper 95 will begin to move in the downward direction when the lever 2 is turned past 100 degrees.

Figure 10A:
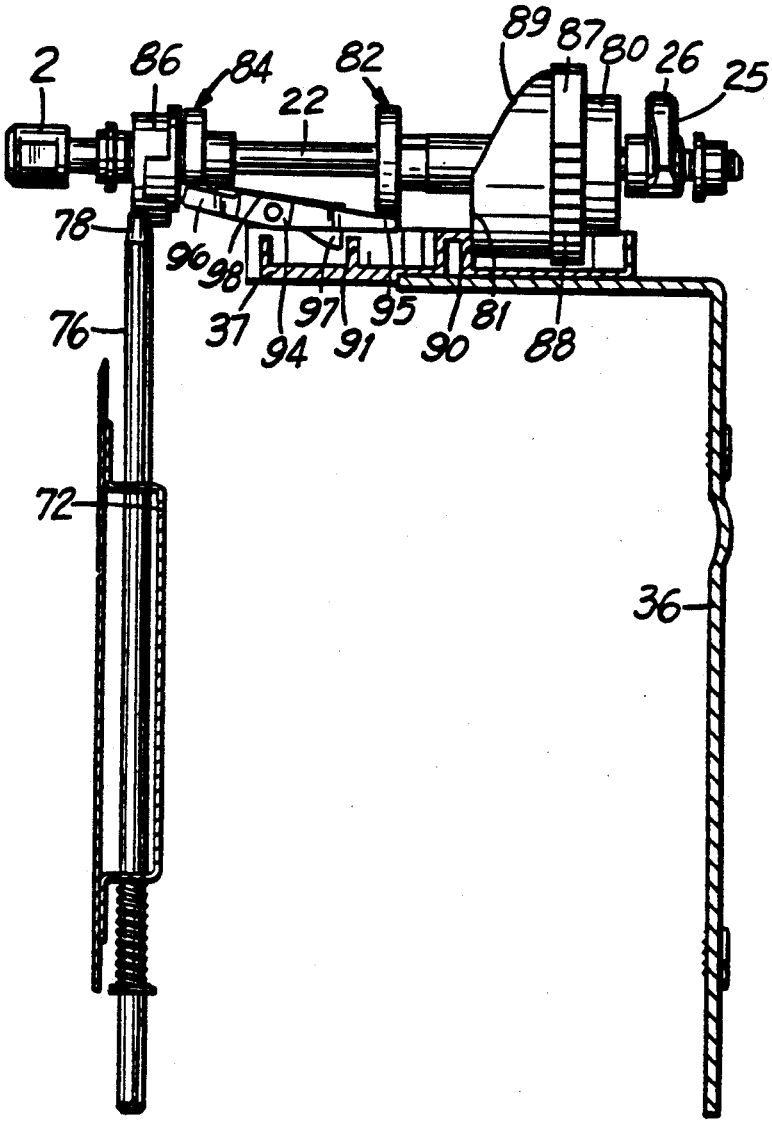
FIGS. 10A and 10B show the cams of FIGS. 8A and 8B rotated to 180 degrees.

FIG. 10A shows the locking mechanism of FIG. 9A rotated further to 180 degrees. At this time, the surface 26 of the locking disc 25 has rotated out of its locking connection with the slot in tongue 220 (shown in FIG. 6) of the bill pusher 204, permitting removal of the cassette 100. The latching radial cam 82 has pushed the stopper 95 in the downward direction which in turn pushes fin 97 below the ledge 91 of the sliding pad 37. The fin 97 thereby prevents the sliding pad 37 and pusher plate 36 from moving towards the lever 2. Thus, the pusher plate 36 cannot be pushed into the bill compartment 30 in an attempt to extract bills.

As explained above, the axial cam 80 contacts the rib 90 to prevent the sliding pad from moving towards the rear wall 9. Consequently, the axial cam 80 and the latch 94 together lock the pusher plate 36 in place to cover the opening 51 (shown in FIG. 5) when the lever 2 is rotated counterclockwise to 180 degrees.

The spring-loaded fin 97 is designed to provide added security in case the actuator plate 212 jams in its extended position (shown in FIG. 6), and the cassette 100 is to be removed. In this event, when the knob or lever 2 is turned counterclockwise 180 degrees the latch 94 will move to its locking position and the fin 97 will be located on the wrong side of the ledge 91. However, as the cassette 100 is removed, the pad springs 38 (shown in FIG. 6) push the sliding pad 37 and pusher plate 36 towards the rear wall of the cassette 100. Meanwhile, the fin 97 collapses into the notch in the latch 94 as the ledge 91 contacts the fin 97 as it moves past. When the ledge 91 clears the fin 97, the leaf spring 98 forces the fin 97 to extend outward to lock the pusher plate 36 in place. Thus, the cassette 100 is secured automatically. If the fin 97 were fixedly mounted, it would contact the wrong side of the ledge 91 thereby jamming pusher plate 36 inside the bill storage compartment 30 to expose the stored bills.

Figure 10B:
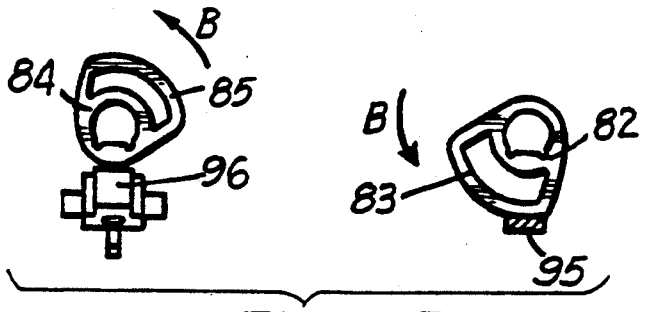

FIG. 10B depicts the unlatching cam 84 and the latching cam 82 when the locking shaft 22 has been turned in the direction of the arrows labeled "B" to 180 degrees. The tripper 96 is in contact with the base of the unlatching cam 84, and the stopper 95 is now fully displaced away from the locking shaft 22 by the cylindrical cam surface 83 of t e latching cam 82. Consequently, as shown in FIG. 10A, the latch 94 and axial cam 80 are in their latched positions, thus the pusher plate 36 cannot be pushed into, or pulled out of, the bill compartment 30.

FIGS. 11A–11D are cutaway front views to illustrate the relationship of the extension spring cam 86 to the latching shaft 22 and to the arming shaft 76. The extension spring cam 86 is made up of two concentric cams, a spring base cam 102 which is mounted on the locking shaft 22, and a finger cam 104 which is rotationally mounted on the spring base cam 102. A finger 106 extends from the finger cam 104, and a raised surface 110 extends from the spring base cam 102. The spring base cam 102 and the finger cam 104 are connected by an extension spring 108.

Figures 11A, 11B, 11C, 11D:
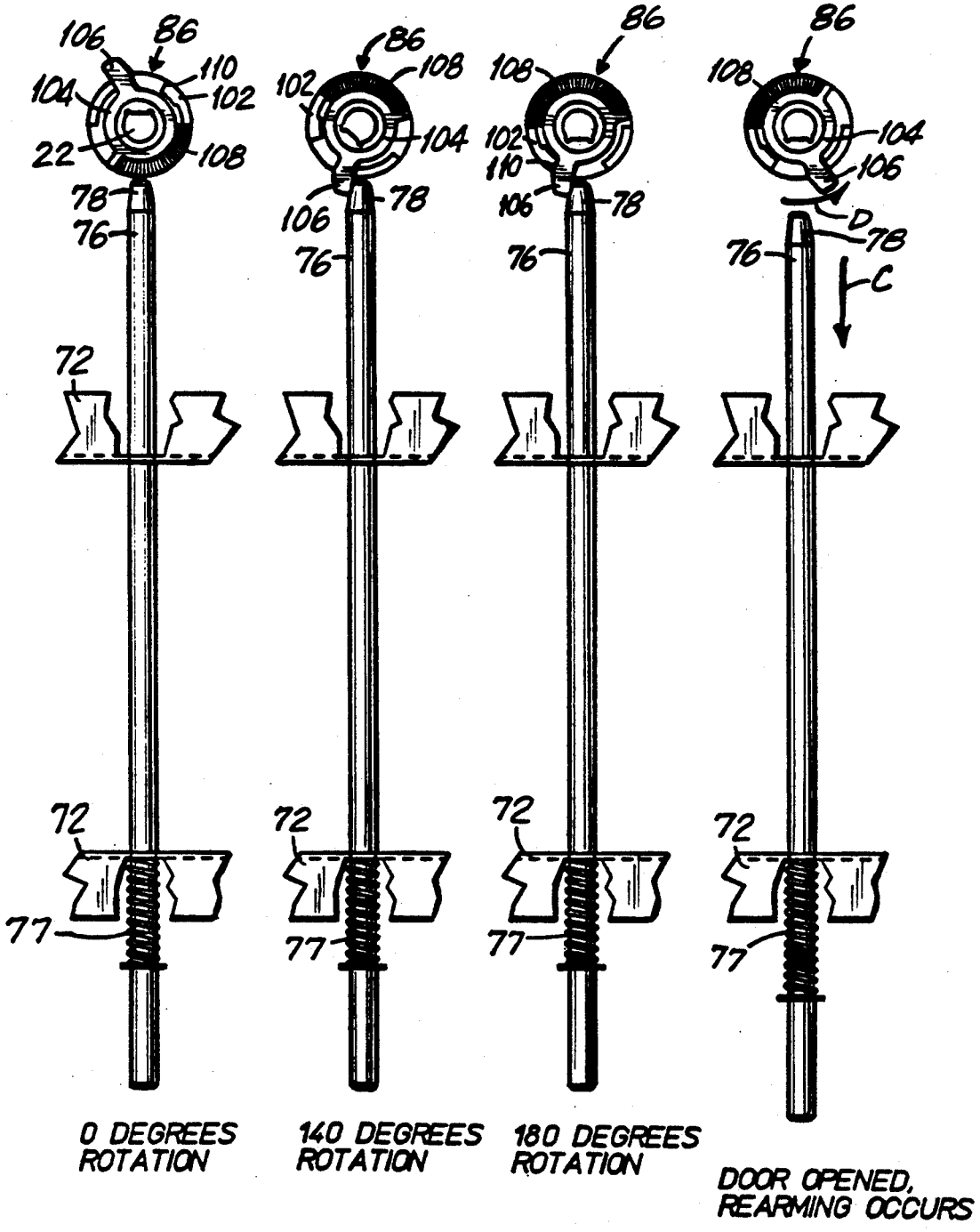
FIGS. 11A–11D are cutaway front views of the lever locking mechanism of the present invention at 0 degrees, 140 degrees, 180 degrees, and after the hinged door has been opened, respectively.

FIGS. 11A to 11C depict the relationship of the extension spring cam 86 to the arming shaft 76 when the knob or lever 2 (shown in FIG. 8A) is at 0 degrees, 140 degrees, and 180 degrees, respectively. During this time the pivoted door 40 (shown in FIG. 3) is closed. A spring 77 is attached to part of the arming shaft housing 72, and biases the arming shaft 76 in the downward direction. The arming shaft 76 has a conical surface 78 at its end closest to the extension spring cam 86.

FIG. 11B depicts the extension spring cam 86 when the lever 2 has been rotated 140 degrees counterclockwise. At 140 degrees, the finger 106 contacts the conical surface 78 of the arming shaft 76, thus stopping further rotation of the finger cam 104. However, the spring base cam 102 can rotate further.

FIG. 11C depicts the extension spring cam 86 when the lever 2 has been turned to 180 degrees. From 140 to 180 degrees, the spring base cam 102 continues to rotate, extending the extension spring 108. At 180 degrees, the surface 110 of the spring base cam 102 contacts the finger 106 of the finger cam 104 to prevent further relative rotation between the spring base cam 102 and the finger cam 104. Thus, further rotation of the spring cam 86 is prevented. Since the spring cam 86 can no longer rotate, the locking shaft 22 and the lever 2 cannot be turned further in the counterclockwise direction, until the finger 106 is released.

FIG. 11D depicts the extension spring cam 86 when the pivoted door 40 (not shown) is opened. The arming shaft 76 succumbs to the bias supplied by coil spring 77 and moves downward in the direction of the arrow labeled "C". Consequently, the conical surface 78 of the arming shaft 76 disengages from the finger 106 of the finger cam 104. The finger cam 104 then succumbs to the bias supplied by the extension spring 108, to rotate past the conical surface 78 in the direction of the arrow labeled "D". When the pivoted door 40 is closed and re-locked, the arming shaft 76 is again moved toward the extension spring cam 86. However, because the finger cam 104 has rotated, the extension spring cam 86 is free to rotate in the counterclockwise direction once again. As a result, the knob or lever 2 can be turned a further 180 degrees by a serviceman to lock the cassette 100 to a validator apparatus 200.

Thus, when a serviceman turns the knob or lever 2 counterclockwise from zero to 180 degrees, the cams and locking mechanisms of the present invention lock the pusher plate 36 in place to securely store the bills within the cassette 100. As explained above, the lever 2 cannot be turned past 180 degrees without unlocking the hinged door 40, and the lever 2 cannot be turned in the clockwise direction. Further, the pusher plate cannot be pushed inwards or pulled outwards once the cassette is detached in an attempt to extract bills through the enlarged opening which would result.

In a contemplated alternate embodiment, the pusher plate 36 is replaced by a perforated rear wall rigidly fixed to the sides 8 of the cassette 100. The perforated rear wall has a number of closely spaced holes which are too small for a bill to fit through. Mounted on the actuator plate 212 of the bill pusher 204 are a series of prongs which correspond to, and fit through, the holes in the perforated rear wall. A bill passageway is located behind the perforated rear wall and in front of an inner wall. The inner rear wall has an opening, similar to that discussed above in conjunction with FIG. 5, to receive accepted bills. The bill is transported through the bill passageway and contacts the detector blades 210 which triggers the actuator plate 212 to move toward the cassette 100. The prongs travel through the holes in the perforated rear wall and push the bill through the opening in the inner wall of the cassette, into the bill storage compartment 30. The bill then contacts a pressure plate and associated conical spring, which biases the pressure plate towards the inner wall of the bill compartment 30.

The alternate embodiment simplifies the camming arrangement discussed above, so that only the locking disc 25 operates as before. Since the perforated rear wall is fixed, there is no longer any need for the latch and the other locking cams. The cassette is removed by turning a lever and the bills are accessed as in the previous embodiment, through a locked, hinged door.

Advantages of the present invention include its durability, ease of use, and tamper resistant design. The invention can withstand ordinary shocks, such as falls from four feet or more, and has been designed to be able to withstand greater shocks without giving access to the stored bills. Towards this end, the use of springs has been minimized. Also, the preferred embodiment of the cassette can be attached to existing bill pushers, wherein the bill pusher requires only minor modifications.

The present invention is easy to use. Service personnel need only rotate a lever to mount and dismount the cassette from the bill validator. The cassette owner need only open one lock and one door to access the stored bills, and rearms the cassette automatically by opening and closing the access door.

Since the cassette is durable, it is difficult to withdraw stored bills illicitly by shocking the cassette. Further, the cassette is manufactured with small clearances about the opening where bills are loaded by the bill pusher, so that no space is left to extract the stored bills when the cassette is detached from the bill validator. In addition, since no special steps are required to arm the cassette, it is less likely that human error will lead to pilferage. Thus, the present invention is tamper resistant and substantially reduces the likelihood that bills will be skimmed from the cassette before delivery to a central office.

Although a preferred embodiment of the invention has been described above, it should be understood that one skilled in the art could make modifications without departing from the scope of the invention, which is defined by the appended claims.

I claim:

1. A lockable, removable cassette apparatus for securely storing bills accepted by a bill validator, comprising:

a housing containing a bill compartment and a locking means;

a mounting means for lockably attaching the housing to the bill validator; and a pusher plate for loading bills through a bill opening into the bill compartment, wherein the pusher plate is connected to the locking means such that when the cassette is removed from the bill validator the pusher plate automatically covers the bill opening and locks in place.

2. The apparatus of claim 1, further comprising:

a knob protruding outwardly from the housing and connected to the locking means.

3. The apparatus of claim 2, wherein the knob is turned from a starting position to a first predetermined position to unlock the cassette from the bill validator and to automatically lock the pusher plate in the closed position, and wherein the knob is turned to a second predetermined position to lock the cassette to the bill validator and release the pusher plate.

4. The apparatus of claim 1, further comprising:

an access door which must be unlocked with a separate key to open to remove the stored bills.

5. The apparatus of claim 4, further comprising:

a linkage means for linking the access door to the locking means, wherein relocking the cassette to the bill validator is prevented unless the access door was opened.

6. The apparatus of claim 4, wherein the access door further comprises ears which engage stored bills when the access door is opened to facilitate removal of the bills.

7. The apparatus of claim 1, wherein the pusher plate further comprises teeth to prevent a bill from slipping when being loaded into the bill compartment.

8. The apparatus of claim 1, wherein the pusher plate further comprises a bump which contacts an actuator plate of the bill validator, wherein the bump is located such that the bending moment of the pusher plate is reduced.

9. The apparatus of claim 1, further comprising:

at least one cassette detection pin for contacting a cassette detection switch of the bill validator to indicate the presence of the cassette and to enable bill validator operation, and which may operate an external signal to monitor cassette removal.

10. A lockable, removable cassette apparatus for connection to a bill pusher of a bill validator for securely storing bills accepted by the bill validator, comprising:

a housing which contains a bill compartment having a bill opening and a pressure plate for holding bills in place, and which contains a locking means;

a mounting means for lockably attaching the housing to the bill pusher;

a pusher plate connected to the locking means and operable to load bills into the bill compartment when the cassette is attached to the bill pusher, and to securely cover the bill opening when the cassette is removed from the bill pusher;

an access door which must be unlocked using a separate key to remove bills; and a linkage means for linking the access door to the locking means such that opening the access door releases the linkage means to unlock the pusher plate and thus to arm the cassette.

11. The apparatus of claim 10, further comprising:

a knob which protrudes from the housing and which is connected to the locking means.

12. The apparatus of claim 11, wherein the knob is turned from a starting position to a first predetermined position to unlock the cassette from the bill validator and to move the pusher plate to a locked position securely covering the bill opening, thus disarming the cassette.

13. The apparatus of claim 12, wherein the knob must be turned to a second predetermined position to reattach the cassette to the bill validator and to unlock the pusher plate.

14. The apparatus of claim 12, wherein the knob cannot be turned to the second predetermined position until the cassette is armed.

15. The apparatus of claim 14, wherein the linkage means and an extension spring cam prevent the knob from turning past the first predetermined position until the access door is opened.

16. The apparatus of claim 10, wherein the locking means comprises:

a shaft connected to the knob;

cams connected to the shaft;

a movable latch; and a slidable plate rigidly connected to the pusher plate, the slidable plate having ribs which contact the latch and the cams, wherein the cams rotate when the knob is turned to unlock the cassette from the bill validator such that the latch and cams are moved to a locking position so that the pusher plate is secured closed, and such that the pusher plate is released when the cassette is reattached to the bill validator.

17. The apparatus of claim 16, wherein a locking disc unlocks the cassette from the bill validator when the knob is turned from a starting position to a first predetermined position, and locks the cassette to the bill validator when the knob is turned to a second predetermined position.

18. The apparatus of claim 17, wherein the knob is turned counterclockwise 180 degrees to reach the first predetermined position.

19. The apparatus of claim 17, wherein the knob is turned counterclockwise 360 degrees to reach the second predetermined position.

20. The apparatus of claim 17, wherein an axial cam rotates to move the pusher plate to the closed position and a latching radial cam rotates to prevent the pusher plate from entering the bill compartment, when the knob is turned to the first predetermined position.

21. The apparatus of claim 20, wherein the axial cam contains ratchet steps which prevent the clockwise rotation of the lever.

22. The apparatus of claim 16, wherein the latch further comprises a fin which acts to lock the pusher plate closed, wherein the fin may be retracted into a notch if contacted from below.

23. The apparatus of claim 22, wherein the fin is biased away from the notch by a leaf spring.

24. A lockable, removable cassette apparatus for securely storing bills accepted by a bill validator, comprising:

a housing containing a bill compartment with a bill opening, and having a locking arrangement;

a connector for lockably attaching the housing to the bill validator;

an access door which must be unlocked by using a separate key to remove stored bills; and an arming shaft for linking the access door to the locking arrangement, such that opening the access door releases the arming shaft from the locking arrangement to arm the cassette.

25. The apparatus of claim 24, further comprising:

a knob protruding from the housing and connected to the locking arrangement.

26. The apparatus of claim 25, further comprising:

a pusher plate connected to the locking arrangement, wherein the pusher plate operates to load bills when the cassette is attached to the bill validator, and to securely cover the bill opening when the cassette is removed from the bill validator.

27. The apparatus of claim 26, wherein the knob is turned from a starting position to a first predetermined position to unlock the cassette from the validator and to move the pusher plate to a locked position securely covering the bill opening to disarm the cassette, and wherein the knob is turned to a second predetermined position to reattach the cassette to the bill validator and to unlock the pusher plate.

28. The apparatus of claim 27, wherein the knob cannot be turned to the second predetermined position unless the cassette is armed.

29. The apparatus of claim 22, wherein the first predetermined position is reached by turning the knob counterclockwise 180 degrees.

30. The apparatus of claim 27, wherein the second predetermined position is reached by turning the knob counterclockwise 360 degrees.

31. The apparatus of claim 29, wherein a cam having ratchet teeth connected to the locking arrangement prevents the clockwise rotation of the knob.

32. A lockable, removable, cassette apparatus for securely storing bills accepted by a bill validator, comprising:

a housing containing a bill compartment and a locking arrangement;

a connector for lockably attaching the housing to the bill validator; and a pusher plate for loading bills through a bill opening into the bill compartment, wherein the pusher plate is connected to the locking arrangement such that when the cassette is removed from the bill validator the pusher plate automatically covers the bill opening and locks in place.

33. The apparatus of claim 32, further comprising:

a knob protruding outwardly from the housing and connected to the locking arrangement, wherein the knob must be turned to one position to remove the cassette, and another position to reattach the cassette.

34. The apparatus of claim 32 further comprising:

an access door which must be unlocked by a separate key to open to remove stored bills.

35. The apparatus of claim 34, further comprising:

a linkage to link the access door to the locking arrangement, wherein reattaching the cassette to the bill validator is prevented unless the access door was opened.

36. A lockable, removable cassette apparatus for storing bills accepted by a bill validator, comprising:

a housing containing a bill compartment and a shaft compartment;

a connector for lockably attaching the cassette to a bill validator;

a locking means housed in the shaft compartment;

a pusher plate connected to the locking means which moves through a bill opening into and out of the bill compartment to load bills when the cassette is attached to the bill validator;

a knob connected to the locking means, such that turning the knob to a first predetermined position unlocks the cassette from the bill validator and secures the pusher plate to cover the bill opening, and turning the knob to a second predetermined position locks the cassette to the bill validator and releases the pusher plate;

an access door which must be unlocked to remove stored bills by using a separate key; and a linkage means to link the access door to the locking means, such that the access door must be opened to permit the knob to be turned to the second predetermined position.

37. The apparatus of claim 36, further comprising:

a flange rigidly attached to a side wall of the cassette wherein a padlock may be used to lock the knob to the flange.

38. The apparatus of claim 36, further comprising:

at least one cassette detection pin, which contacts a cassette detection switch in the bill validator to indicate the presence of the cassette to enable bill validator operation, and which may operate an external signal to monitor cassette removal.

39. The apparatus of claim 36, wherein the access door has ears to provide an uneven line of separation when closed, and to contact stored bills to facilitate their removal when opened.

40. The apparatus of claim 36, wherein the bill compartment may be manufactured to hold whatever amount of bills a customer requires.

41. The apparatus of claim 46, wherein the bill compartment holds approximately 600 bills.

* * * * *

UNITED STATES PATENT AND TRADEMARK OFFICE

CERTIFICATE OF CORRECTION

PATENT NO. : 5,209,395
DATED : May 11, 1993
INVENTOR(S) : Zouzoulas, et. al.

It is certified that error appears in the above-indentified patent and that said Letters Patent is hereby corrected as shown below:

On the Title page, item [54], Title, line 2, change "CASSETT", to--CASSETT--.

Column 7, line 45, change "ears 4" to -- ears 54 --.

Column 10, line 7, change "t e" to -- the --.

Claim 29, column 14, line 29, change "22" to -- 27 --.

Claim 41, column 16, line 18, change "46" to -- 40 --.

Signed and Sealed this

Seventh Day of June, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,209,395

DATED : May 11, 1993

INVENTOR(S) : Zouzoulas, et al.

It is certified that error appears in the above-indentified patent and that said Letters Patent is hereby corrected as shown below:

On the Title page, item [54], Title, line 2, change "CASSETTE," to --CASSETTE--.

Column 7, line 45, change "ears 4" to -- ears 54 --.

Column 10, line 7, change "t e" to -- the --.

Claim 29, column 14, line 29, change "22" to -- 27 --.

Claim 41, column 16, line 18, change "46" to -- 40 --.

This certificate supersedes Certificate of Correction issued June 7, 1994.

Signed and Sealed this

Twenty-seventh Day of June, 1995

*Attest:*

Bruce Lehman

BRUCE LEHMAN

*Attesting Officer*

*Commissioner of Patents and Trademarks*